US007189167B1

(12) United States Patent
Imahata

(10) Patent No.: US 7,189,167 B1
(45) Date of Patent: Mar. 13, 2007

(54) GAME APPARATUS HAVING BALL DROP AND PICK-UP MECHANISM

(76) Inventor: Takeo Imahata, 7390 Woodsboro Ave., Anaheim, CA (US) 92807

( * ) Notice: Subject to any disclaimer, the term of this patent is extended or adjusted under 35 U.S.C. 154(b) by 0 days.

(21) Appl. No.: 11/323,264

(22) Filed: Dec. 30, 2005

(51) Int. Cl.
*A63B 53/00* (2006.01)
*A63B 47/02* (2006.01)
*A63B 47/00* (2006.01)

(52) U.S. Cl. ..... 473/282; 473/286; 473/132; 221/295

(58) Field of Classification Search ..... 473/282, 473/286, 132, 137; 221/295, 194, 151–152, 221/272–274, 276; 294/19.2
See application file for complete search history.

(56) References Cited

U.S. PATENT DOCUMENTS 6,488,593 B2 * 12/2002 Imahata ..... 473/282

* cited by examiner

*Primary Examiner*—Stephen Blau
(74) *Attorney, Agent, or Firm*—Muramatsu & Associates

(57) ABSTRACT

A game apparatus is able to drop the balls one by one on the ground and to pick-up the balls on the ground one by one. The game apparatus includes a ball guide to store a plurality of balls to be movable by their own weight, an upper support provided at an upper portion of the ball guide, a lower housing provided at a lower portion of the ball guide, a ball stopper mechanism provided in the lower housing to stop and release the movement of the ball in the vertical direction, a drive part to stop and release the movement of the ball by the ball stopper mechanism, and a lever to operate the drive part from outside. The lever includes a ball picking mechanism for picking balls on the ground when the game apparatus is turned upside-down and pressed on the ball on the ground.

13 Claims, 15 Drawing Sheets

GAME APPARATUS HAVING BALL DROP AND PICK-UP MECHANISM

FILED OF THE INVENTION

This invention relates to a game apparatus having a mechanism to drop a spherical object. More particularly, this invention relates to a game apparatus having a mechanism to drop a ball to an arbitrary location on the ground in a simple manner that can be used either by itself or in a condition where the game apparatus is mounted on a stand, and having a ball picking mechanism that facilitates quick and easy picking of golf balls on the ground.

BACKGROUND OF THE INVENTION

Men and women of all ages are enjoying the game of golf these days. Golf is a game to hit the ball having a diameter of about 4 cm (centimeter) on the ground with a lesser number of strokes to put the ball in a hole or cup on the ground (green).

The game of golf can be roughly classified into a process of placing the ball onto a green where a hole is provided, and a process of putting for hitting the ball on the green with a putter to bring the ball into the hole.

The practice of putting purports to put the ball, or a spherical objected placed on the ground into a hall. The putting is also enjoyed for its own sake as recreation. This invention is directed to a game apparatus which is similar to a golf putter, although it is not limited to the putter. However, for the convenience of explanation, the following description is made for the case where the game apparatus is applied to the golf putting.

When a player practices putting or plays putting as recreation, the player has to place balls on the ground (placement process). Hence, in order to practice putting ten (10) times, for example, the player has to place the ball ten times. To repeat such a simple routine of placing the ball is boring and frustrating. Moreover, bending down to place a ball on the ground may pose significant difficulty for an elderly player or a player with a back pain. When a player practices putting with many balls, the player has to carry a container storing many balls such as a bag or a basket.

Thus, it is desired to achieve means for easily and automatically placing the balls on the ground without a player's action to bend over the ground to place the balls. A possible apparatus to achieve this objective can be classified into two, an apparatus mounting a spherical object drop mechanism, i.e., a ball to a club, and an apparatus having a spherical object drop mechanism separately from the golf club.

Some users prefer to use a separate ball drop mechanism and shuns the idea of mounting the drop mechanism to the golf club due to the affect to the user's sense by the addition of the drop mechanism. Others may prefer an drop mechanism attached to a golf club. Thus, there is a need to accommodate many types of users. Moreover, since balls must be picked to contiguously play or practice, there is a need to allow the user to easily pick the balls on the ground.

SUMMARY OF THE INVENTION

Therefore, it is an object of the present invention to provide a mechanism to drop a ball on the ground and pick-up the balls on the ground for use with a golf putter or a game apparatus similar to a golf putter.

It is another object of the present invention to provide a mechanism to support and hold the game apparatus vertically on the ground so that the game apparatus can be used as a ball dispenser.

It is a further object of the present invention to provide a game apparatus which includes a ball drop mechanism, a ball pick-up mechanism, a stand and a ball storage to drop and pick-up the balls by a simple and inexpensive construction.

The game apparatus of the present invention includes a ball guide to store a plurality of balls to be movable in a vertical direction by their own weight, an upper support provided at an upper portion of the ball guide, a lower housing provided at a lower portion of the ball guide, a ball stopper mechanism provided in the lower housing to stop and release the movement of the ball in the vertical direction, a drive part to stop and release the movement of the ball by the ball stopper mechanism; and a lever to operate the drive part from the outside. The lever includes a ball picking mechanism for picking the ball on the ground when the game apparatus is turned upside-down and pressed on the ball on the ground.

The game apparatus of the present invention further comprises a stand for supporting and holding the game apparatus vertically on the ground so that the game apparatus functions as a ball dispenser and a ball exit guide formed at a bottom of the lower housing where the ball exit guide is curved or inclined to guide the ball from an upper center of the stand to outside of the stand.

The ball picking mechanism of the game apparatus of the present invention includes an opening for introducing the balls to the ball guide, and a latch rim at an inner perimeter of the opening. An example of the latch rim in the ball picking mechanism is a ring spring mounted on an inner wall of the opening. The ring spring has an inner diameter which is slightly smaller than an outer diameter of the ball. The ring spring functions to extend the inner diameter when the ball is introduced in the opening and to produce resistance after the ball has passed through the ring spring by contracting the inner diameter.

According to the present invention, the game apparatus is able to drop the balls one by one on the ground and to pick-up the balls on the ground one by one. Since the ball drop and pick-up mechanisms of the present invention have a simple configuration, it can achieve high reliability, ease of production, ease of use, and less needs of maintenance. Accordingly, it is able to produce the game apparatus of the present invention at low cost, light-weight, and high physical strength.

Accordingly, the game apparatus of the present invention can be enjoyed by variety of users due to the utility that allows the game apparatus to be used in either a separate ball dispenser or an integrated golf club, as well as a ball picking device that allows the user to pick-up the balls on the ground.

BRIEF DESCRIPTION OF THE DRAWINGS

FIG. 4A is a top view thereof, FIG. 4B is a front view thereof as viewed from an arrow A of FIG. 4A, FIG. 4C is a left side view thereof as viewed from an arrow B of FIG. 4A, and FIG. 4D is a right side view of the stand as viewed from an arrow C of FIG. 4A.

FIG. 5A is a top view thereof, and FIG. 5B is a cross-sectional side view thereof showing the inner structure of the lever.

DETAILED DESCRIPTION OF THE INVENTION

The game apparatus having a ball drop (spherical object) mechanism of the present invention can be carried around with a plurality of spherical objects (such as golf balls) stored therein. Moreover, the user can drop the spherical objects such as golf balls on the desired locations of the ground by operating a handle or a lever of the drop mechanism. The game apparatus of the present invention can also pick-up the balls on the ground by a simple operation.

Figure 1A:
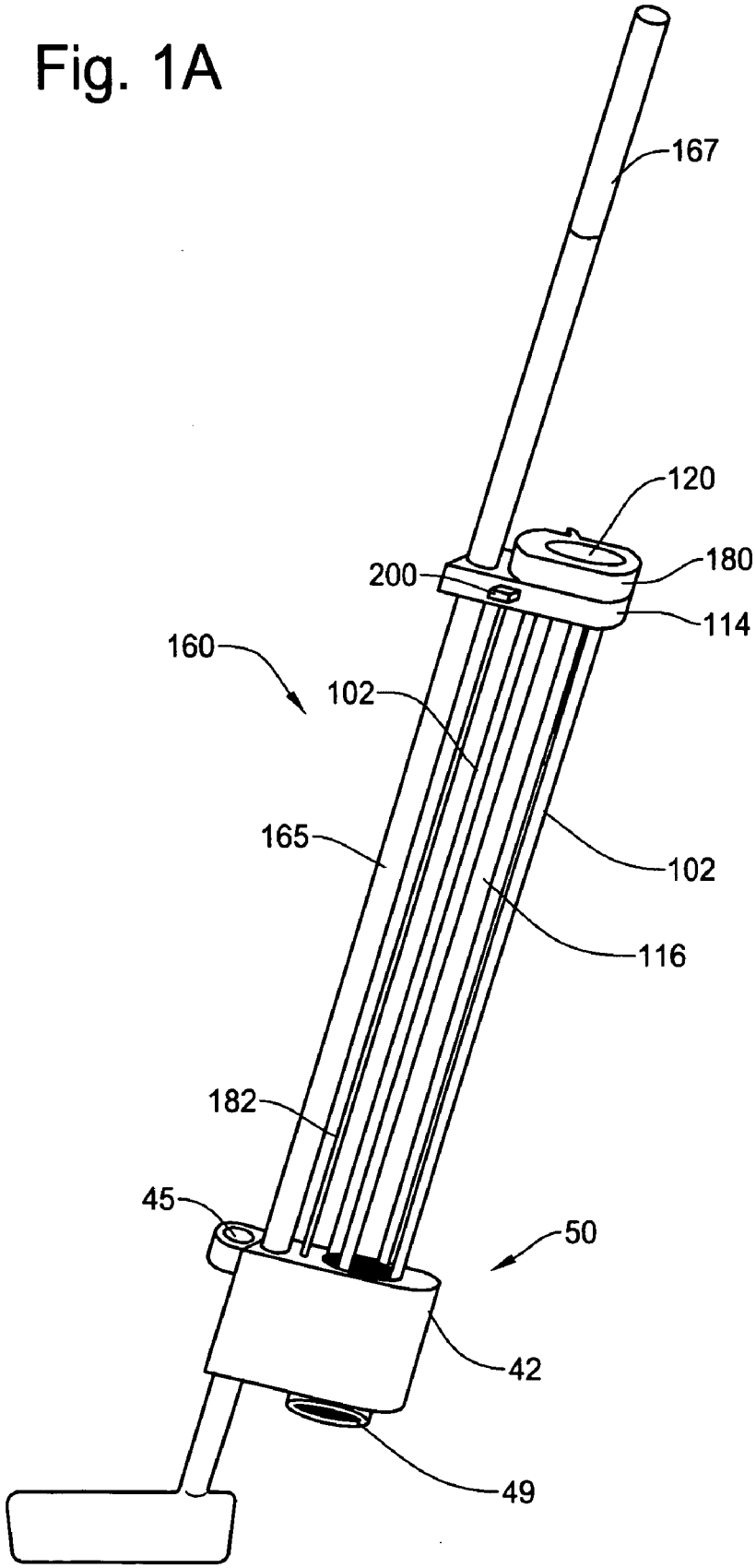
FIGS. 1A–1D are perspective views showing an outer appearance of the game apparatus of the present invention where the spherical object drop mechanism is attached to a golf club in FIG. 1A, the grip part of the golf club is removed in FIG. 1B, the grip part is attached to a holder in FIG. 1C, and the spherical object drop mechanism is mounted on the stand in FIG. 1D.

The game apparatus having a ball (spherical object) drop mechanism of the present invention is explained with reference to FIG. 1A. In the embodiment shown in FIG. 1A, a spherical object drop mechanism 50 for game apparatus of the present invention is attached to a golf club 160 such as a putter. The spherical object drop mechanism 50 is attached to a shaft 165 of the golf club 160 through, for example, screws. The spherical object drop mechanism 50 of the present invention has an upper support 114 at its upper portion thereof, a lower housing 42 at its lower portion, and a ball guide (ball storage) 102 in the middle.

The upper support 114 has a ball insertion opening for a user to introduce the balls there through. A lever 180 is provided on the upper support 114. The lever 180 has an opening 120 to allow the balls pass through. In a normal condition, the opening provided at the upper support 114 and the opening 120 of the lever 180 are aligned such that a golf ball can pass through both of the openings. The inserted balls are guided by the ball guide 102 so that they can be dispensed by the spherical drop mechanism 50 provided in the lower housing 42.

Moreover, on the upper support 114, a lock bar 200 is provided to prevent the balls from dropping out from the ball insertion opening 120. The details of the structure and operation of the lock bar 200 is described in U.S. Pat. No. 6,488,593, which is incorporated herein by reference. Although the lock bar 200 provided in this is preferable, the lock bar 200 can be omitted.

The ball guide 102 stores balls, and directs the balls to the lower housing 42 by the weight of the balls. The ball guide 102 forms a ball passage cylinder 116 for the balls to pass therethrough. Although not specifically shown in the drawings, the ball passage cylinder 116 functions to store a large number of balls because of its long and cylindrical shape.

The spherical object drop mechanism 50 for the game apparatus of the present invention has a drive part (shaft) 182 that extends from the upper support 114 to the lower housing 42. The drive part 182 functions to transmit the rotational movement of the lever 180 to the ball stopper mechanism (ball stopper ring) 46 (not shown in FIG. 1A) in the lower housing 42. The construction and the movement of the lever 180, the drive part 182, and the ball stopper ring 46 will be explained in detail later. The ball exit guide 49 is attached to the lower portion of the lower housing 42 as will be explained in more detail.

Figure 1B:
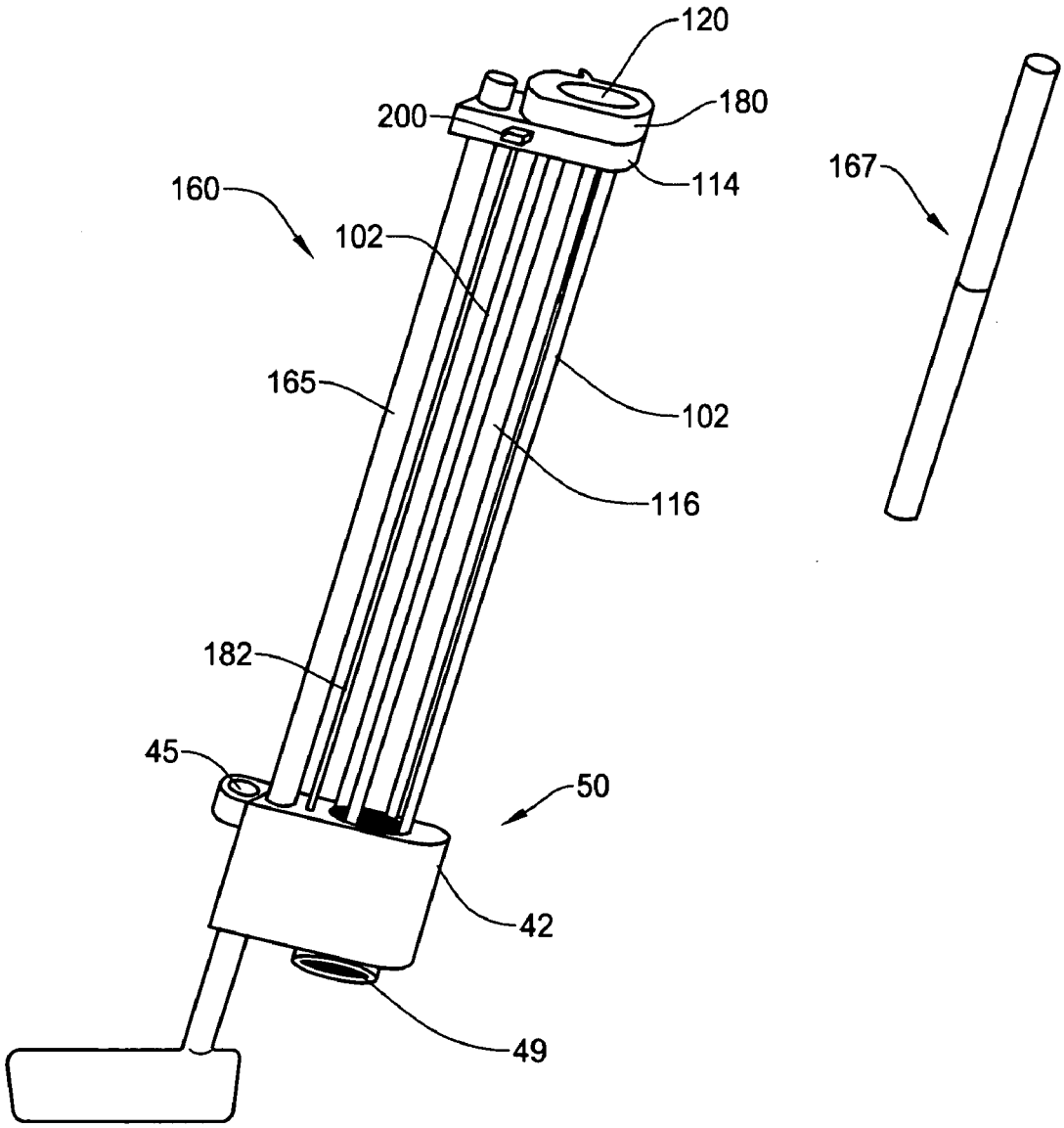
Figure 1C:
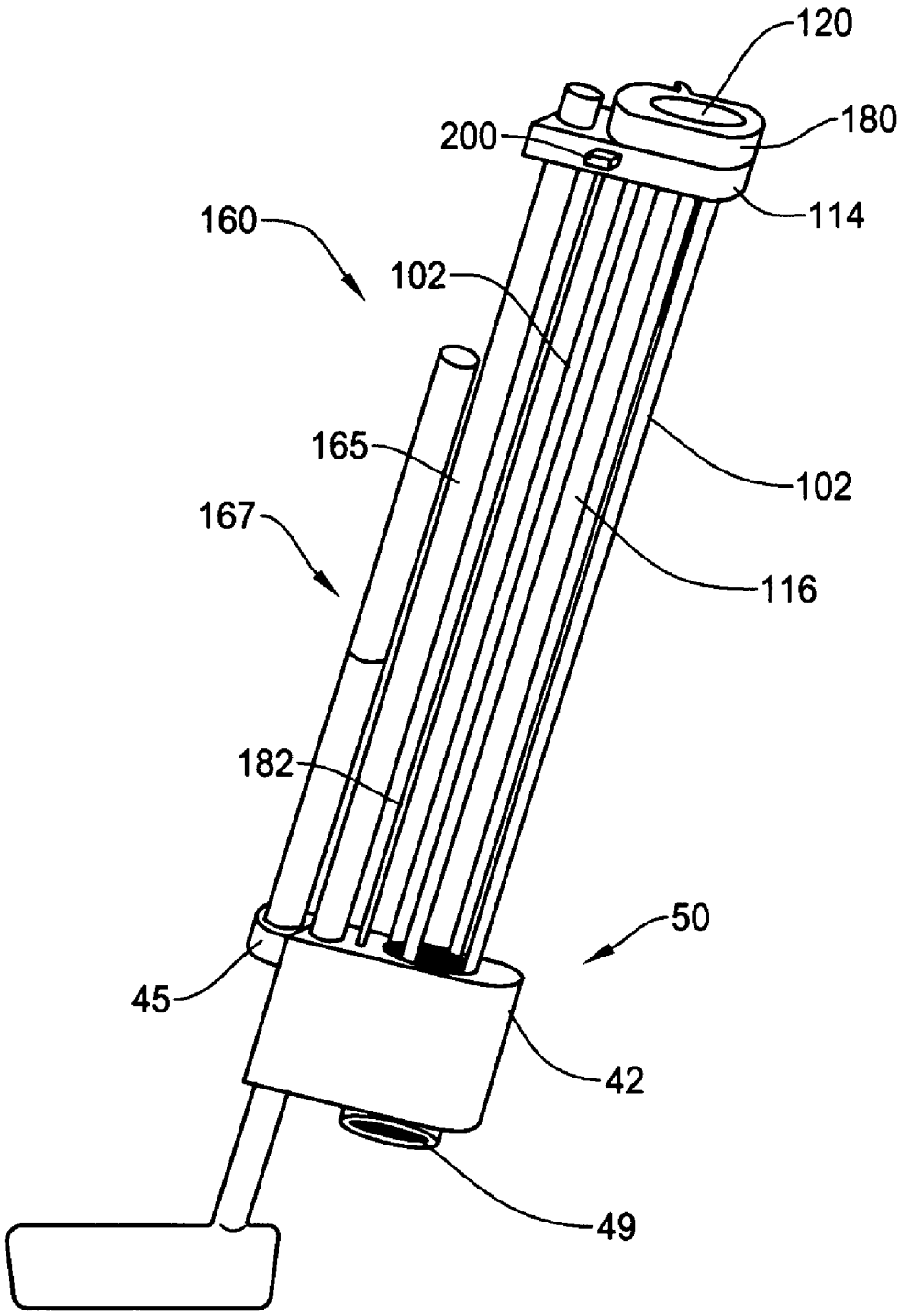

FIG. 1B shows an example wherein the upper part 167 of the club including the grip is disconnected from the shaft 165 for easy carrying around. The golf club or a similar game apparatus may be either a commercially available club or a specially made club for the drop mechanism 50. By reducing the length of the club as shown in FIG. 1B, the user can easily and conveniently carry around the spherical object drop mechanism 50 for game apparatus of the present invention. A shaft holder 45 provided at the lower housing 42 is used to hold the detached upper part 167. As shown in FIG. 1C, the upper part 167 can be attached to the shaft holder 45 thereby carrying of the gamer apparatus is made easy.

Figure 1D:
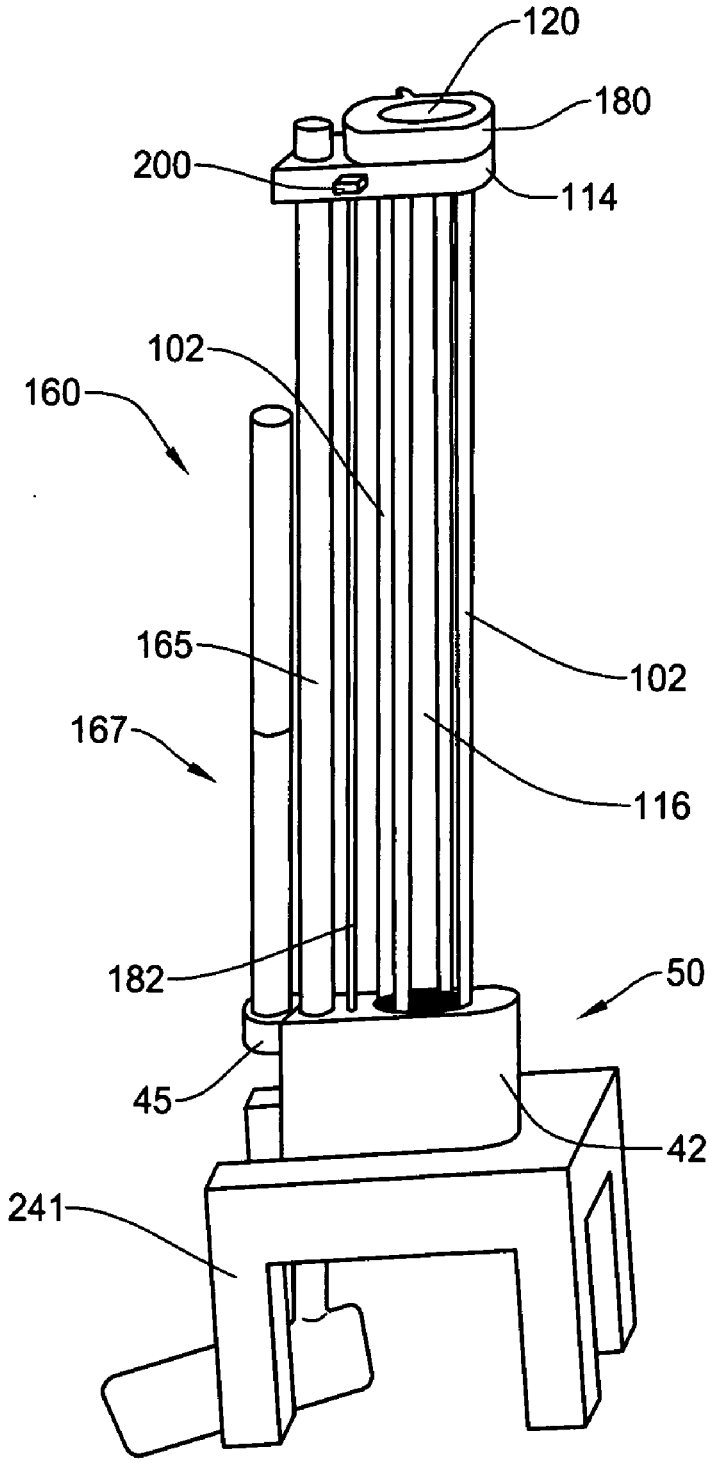

FIG. 1D is a perspective view showing the condition wherein the game apparatus having the ball drop mechanism 50 of the present invention is mounted on a stand 241. The stand 241 supports and holds the game apparatus having the ball drop mechanism 50 so that the game apparatus stands substantially in a vertical direction on the ground. The stand 241 allows the game apparatus to function as a separate ball dispenser.

That is, the user can use a separate golf club and does not use the golf club 160 attached to the ball drop mechanism 50 of the present invention. Thus, in this case, the game apparatus of the present invention is solely used as a ball dispenser for dropping the balls one by one. An embodiment of the stand 241 and its construction will be described with reference to FIGS. 3 and 4A–4D.

Figure 2:
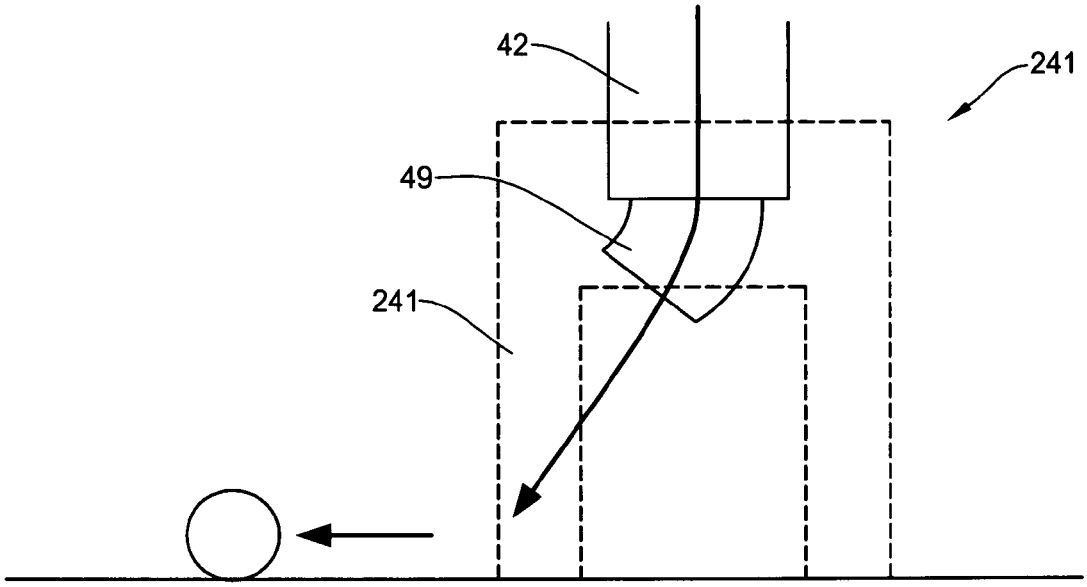
FIG. 2 is a side view showing the lower portion of the spherical object drop mechanism mounted on the stand to show a ball guide and a path of the ball.

The function of the ball exit guide 49 is described with reference to FIG. 2. The side view of FIG. 2 shows the lower portion of the spherical object drop mechanism 50 that is mounted on the stand 241. The stand 241 is represented by dotted lines in this drawing and is typically placed on the ground. The ball exit guide 49 is attached to bottom of the lower housing 42. In this example, the ball exit guide 49 is curved or inclined to guide the ball from the upper center of the stand 241 to the outside of the stand 241 as shown in FIG. 2.

The arrows indicate the direction of the ball that is released from the lower housing 42 of the spherical object drop mechanism 50. Due to the curvature of the ball exit guide 49 noted above, the ball dropped from the lower housing 42 is directed to the outside of the stand 241 in a predetermined direction. Thus, by appropriately placing the stand 241, the ball can be placed in front of the head of the gold club by the ball exit guide 49.

Figure 3:
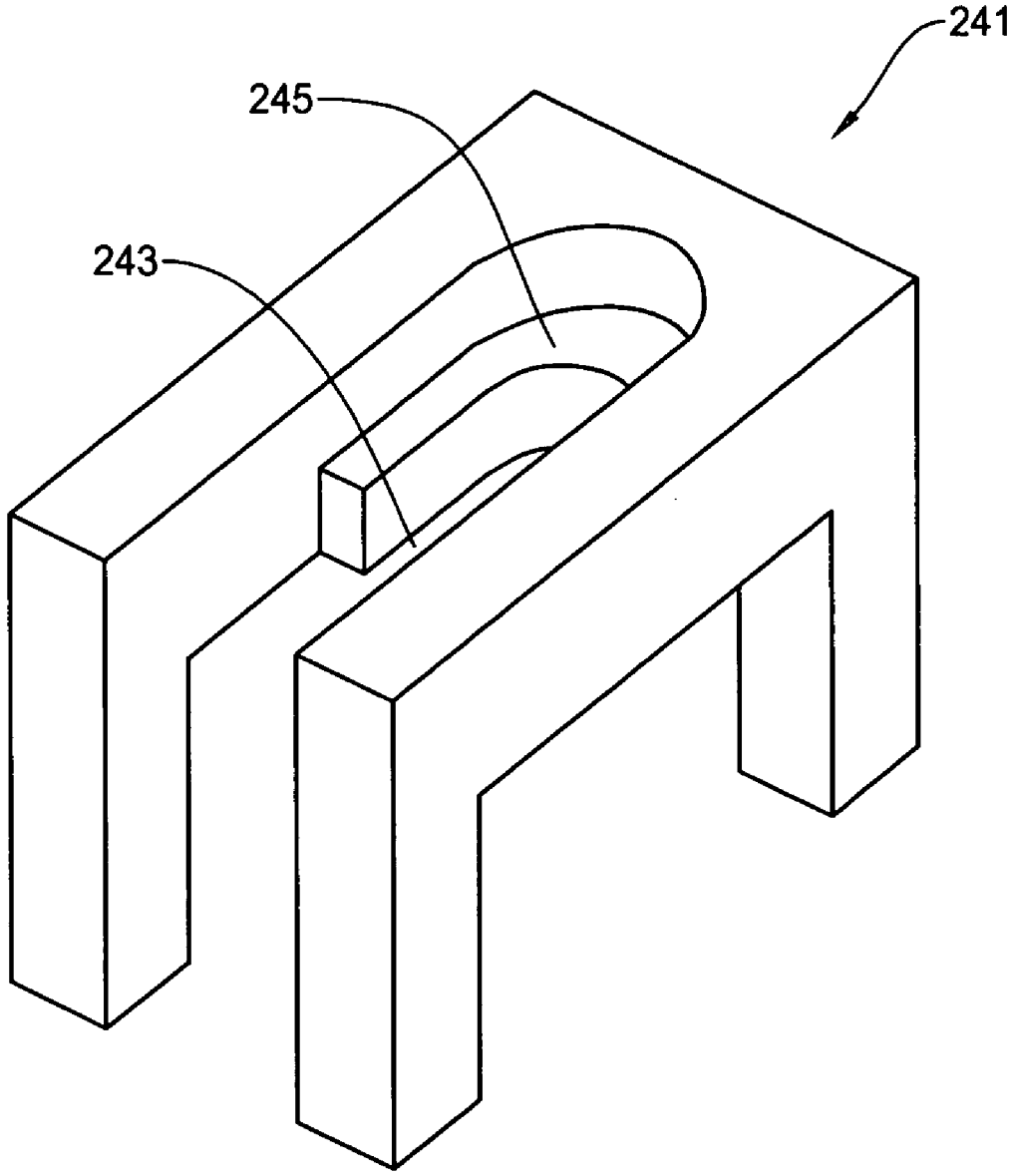
FIG. 3 is a perspective view of showing an example of structure of the stand used in the game apparatus of the present invention.

FIG. 3 is a perspective view showing an example of structure of the stand 241 for the game apparatus of the present invention. The stand 241 is a generally four-legged frame that has a receptacle base 243. The receptacle base 243 receives the lower housing 42 of the spherical object drop mechanism 50. The shape and the size of the receptacle base 243 is such that the lower housing 42 can snugly fit into the receptacle base 243.

The game apparatus is made to a standing position on the stand 241 as shown in FIG. 1C. A part of the receptacle base 243 has a through opening 245 that allows the ball exit guide 49 and its opening to pass there through so that a ball can be dropped on the ground. An adequate clearance is provided at one side of the stand for the head and shaft of the golf club attached to the spherical object drop mechanism 50.

Figure 4A:
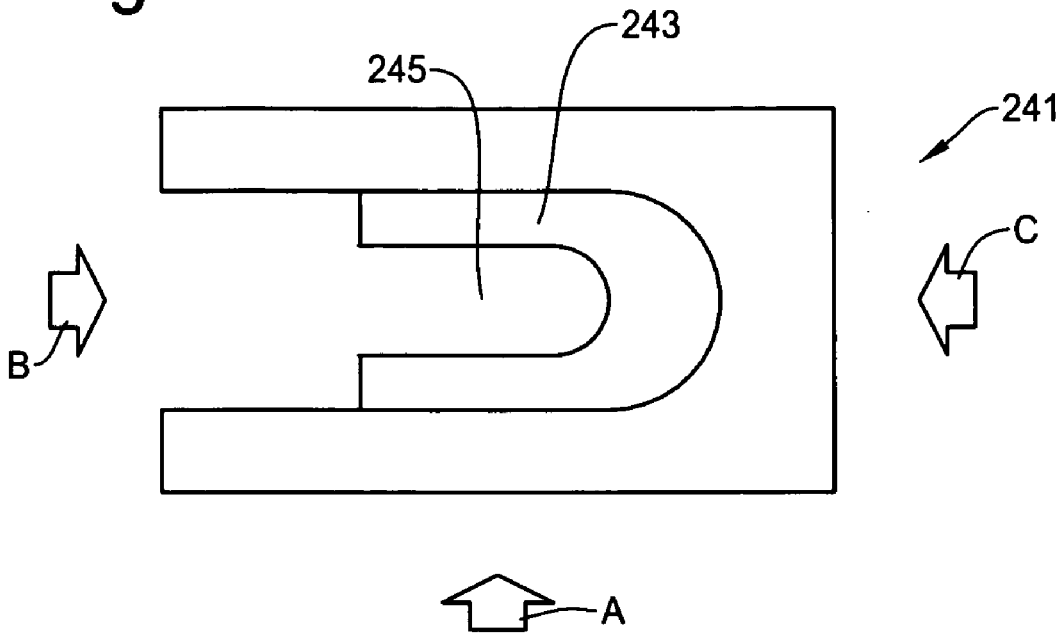
FIGS. 4A–4D show an example of structure of the stand used in the game apparatus of the present invention where
Figure 4B:
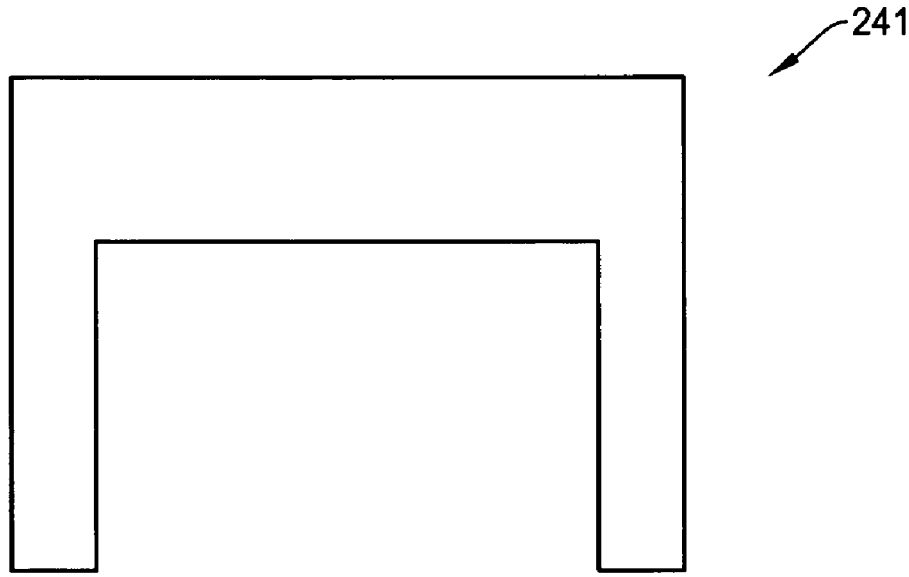

FIGS. 4A–4D showing an example of structure of the stand 241 as viewed from various directions. FIG. 4A is a top view showing the stand 241 of the present invention. The stand 241 has the receptacle base 243, whereon the lower housing 42 of the spherical object drop mechanism 50 is placed. FIG. 4B is a front view of the stand 241 viewed from the side indicated by an arrow A in FIG. 4A. The rear view of the stand 241 is identical to the front view of FIG. 4B and is therefore omitted. Two legs at the front are shown in FIG. 4B. The space provided between the two legs minimizes the weight of the stand 241, as well as provides a clearance for the ball to pass through.

Figure 4C:
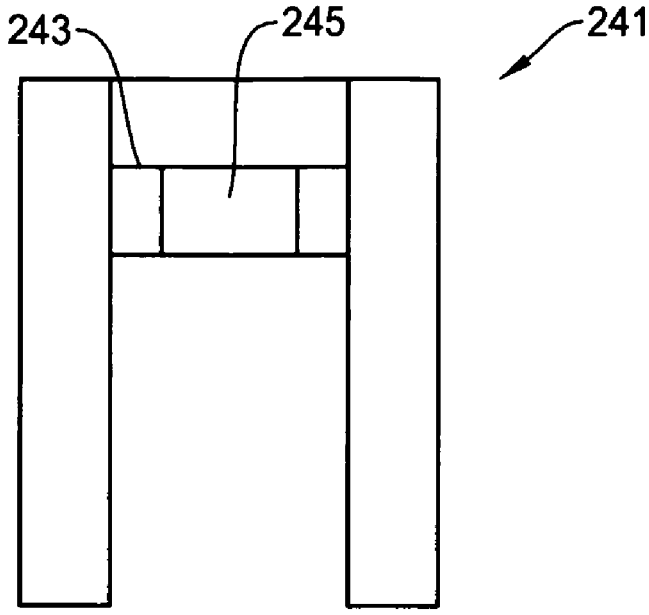
Figure 4D:
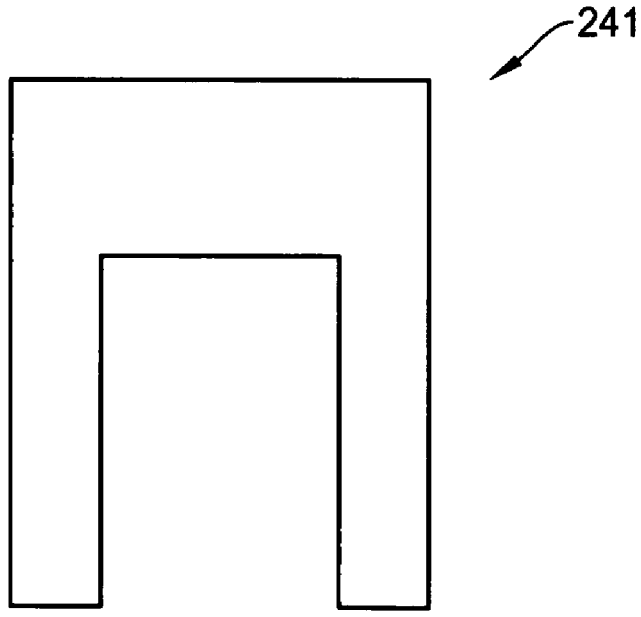

FIG. 4C is a left side view of the stand 241 viewed from the side indicated by an arrow B in FIG. 4A. The receptacle base 243 supports the lower housing 42 so that the game apparatus can stand vertically by itself as shown in FIG. 1C. FIG. 4D is a right side view of the stand 241 viewed from the side indicated by an arrow C in FIG. 4A. Although the stand 241 in the embodiment described above is a four-legged stand, the stand 241 may take other forms, such as a tripod stand. Moreover, the stand 241 may have a slide (rail) that direct the ball dropped from the lower housing 42 to a desired location.

The game apparatus under the present invention is capable of picking the balls on ground by simply pressing down the game apparatus on the ball. Consequently, the user need not bend over the balls to pick them up, thereby preventing back injury when collecting the balls on the ground. The ball picking mechanism of the present invention is provided in the lever 180 at the upper portion of the game apparatus as will be described in detail below.

Figure 5A:
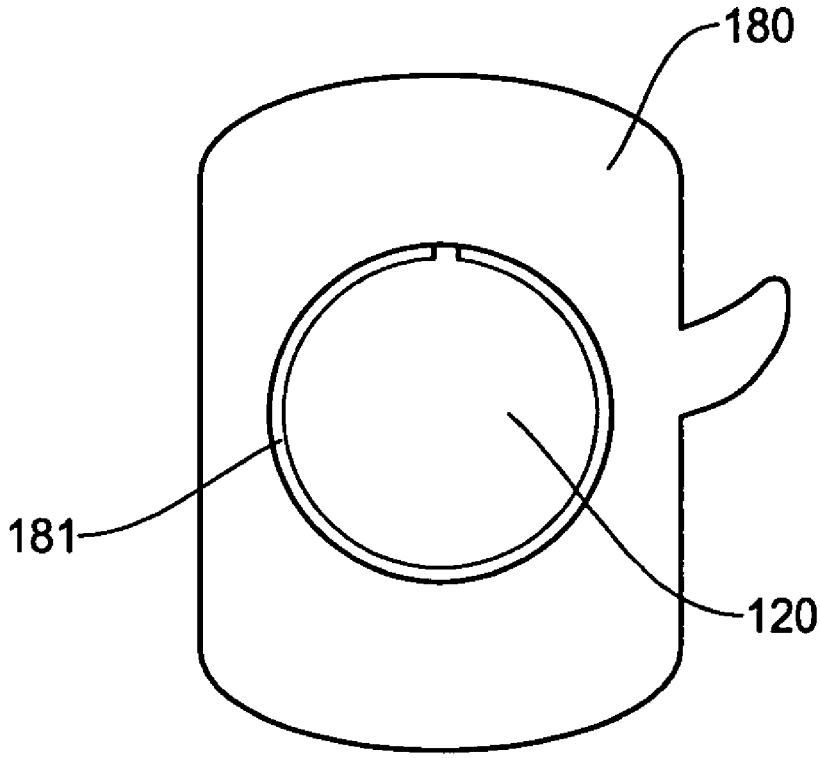
FIGS. 5A and 5B show an example of structure of the lever in the game apparatus of the present invention having the ball pick-up mechanism, where

FIG. 5A is a top view of the lever 180 which includes the ball picking mechanism of the present invention. The lever 180 is attached to the upper support 114 of the game apparatus, and is able to drive the shaft 182 which is connected to a ball stopper ring (ball stopper mechanism) 46. As shown in FIG. 5A, the lever 180 has an opening 120 that has the size similar to the ball.

Figure 5B:
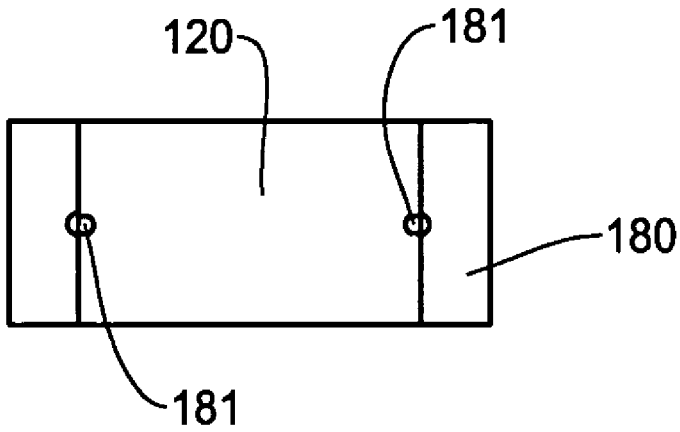

The latch rim (spring) 181 is provided at the inner perimeter of the opening 120. The relationship between the latch rim 181 and the opening 120 of the lever 180 is more clearly illustrated in the cross-sectional view of FIG. 5B. The latch rim 181 is slightly smaller in diameter than the opening 120. An example of latch rim 181 is a ring spring mounted on an inner wall of the opening 120. The latch rim 181 functions to extend its inner diameter when the ball is inserted in the opening 120 and to produce adequate resistance after the ball has passed through the latch rim 181 in the opening 120 by contracting the inner diameter.

Figure 6A:
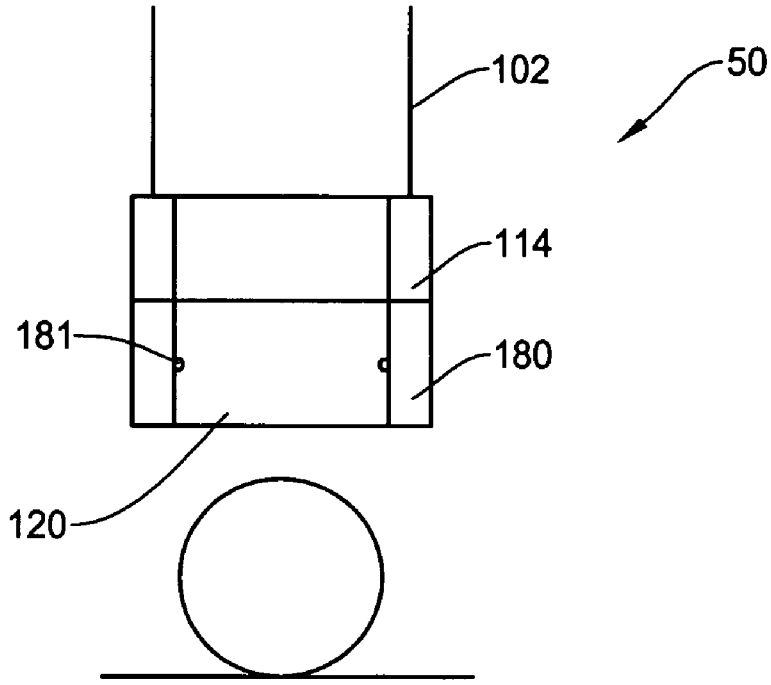
FIGS. 6A–6E are schematic cross-sectional side views showing the steps of picking a ball on the ground by the ball pick-up mechanism of the present invention.

The steps of picking a ball on the ground are described with reference to FIGS. 6A to 6E. With reference to FIG. 6A, the upper part of the spherical object drop mechanism 50 comprising the lever 180, the upper support 114, and the ball guide (ball storage) 102. As can be seen, the spherical object drop mechanism 50 is turned upside-down when balls on the ground are to be picked.

Figure 6B:
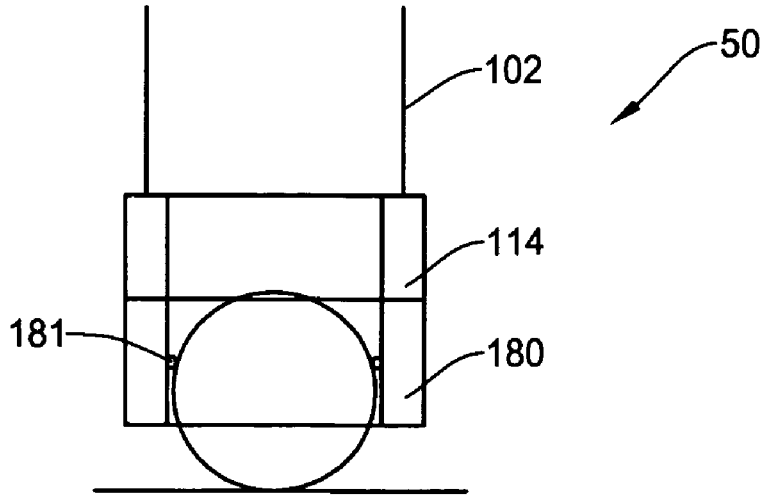

FIG. 6B shows the condition where the user presses down the spherical object drop mechanism 50 on the golf ball. Although the opening 120 is slightly larger than the perimeter of the golf ball, the inner diameter of the latch rim 181 is designed to be slightly smaller than the perimeter of the golf ball. Thus, when the user presses down the spherical object drop mechanism 50 to the ground, the user will meet some resistance.

Figure 6C:
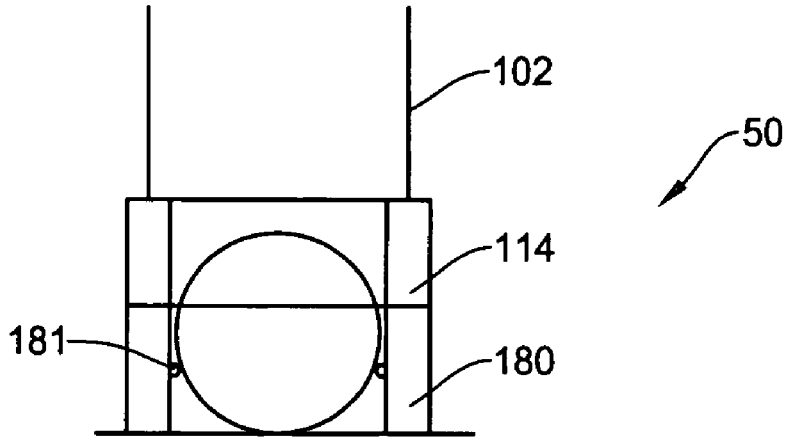
Figure 6D:
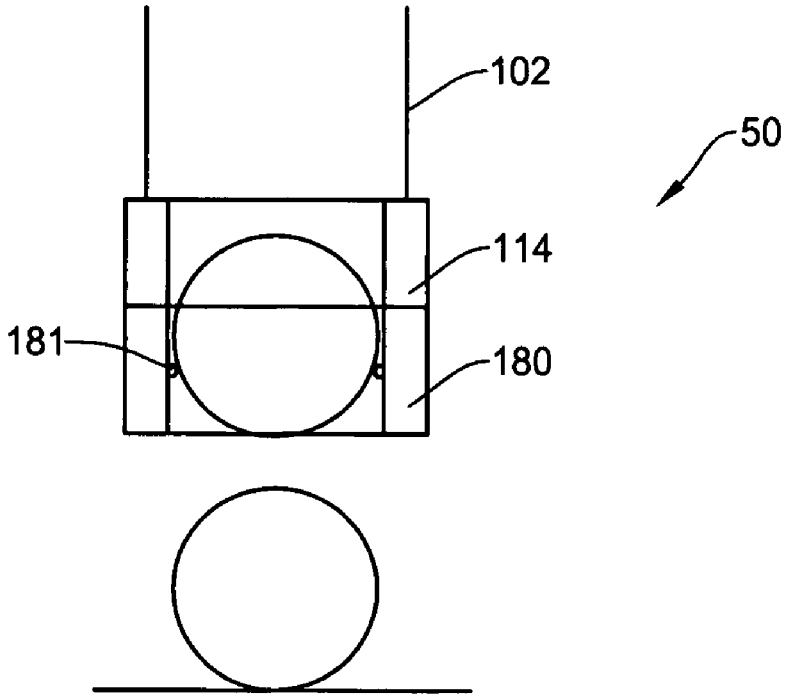
Figure 6E:
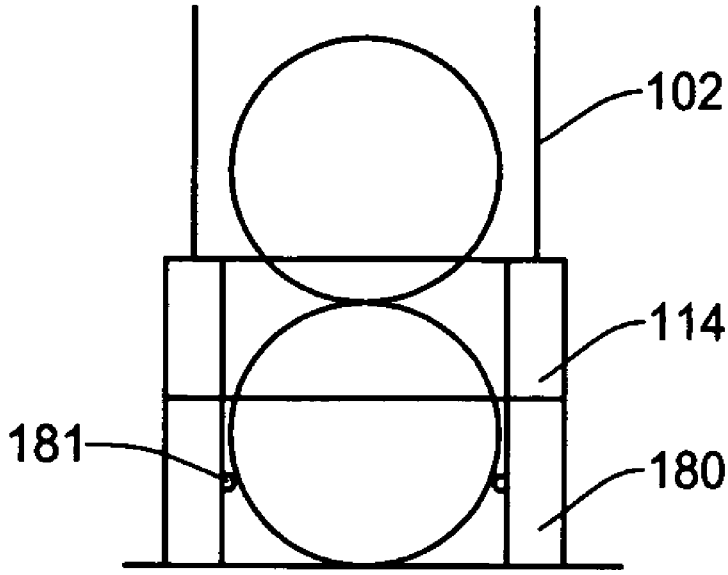

Due to the elasticity of the latch rim 181, when a certain amount of force is applied downward, the ball will pass the latch rim 181 as shown in FIG. 6C. Due to the latch rim 181, which is typically a ring spring, the ball will not drop because the latch rim 181 returns to the normal size of the inner diameter. Likewise, the user can continuously pick the ball as shown in FIGS. 6D–6E.

The basic configuration and operation of the spherical object drop mechanism 50 that can be used for the game apparatus of the present invention is explained with reference to FIGS. 7, 8A–8B, and 9A–9C.

Figure 7:
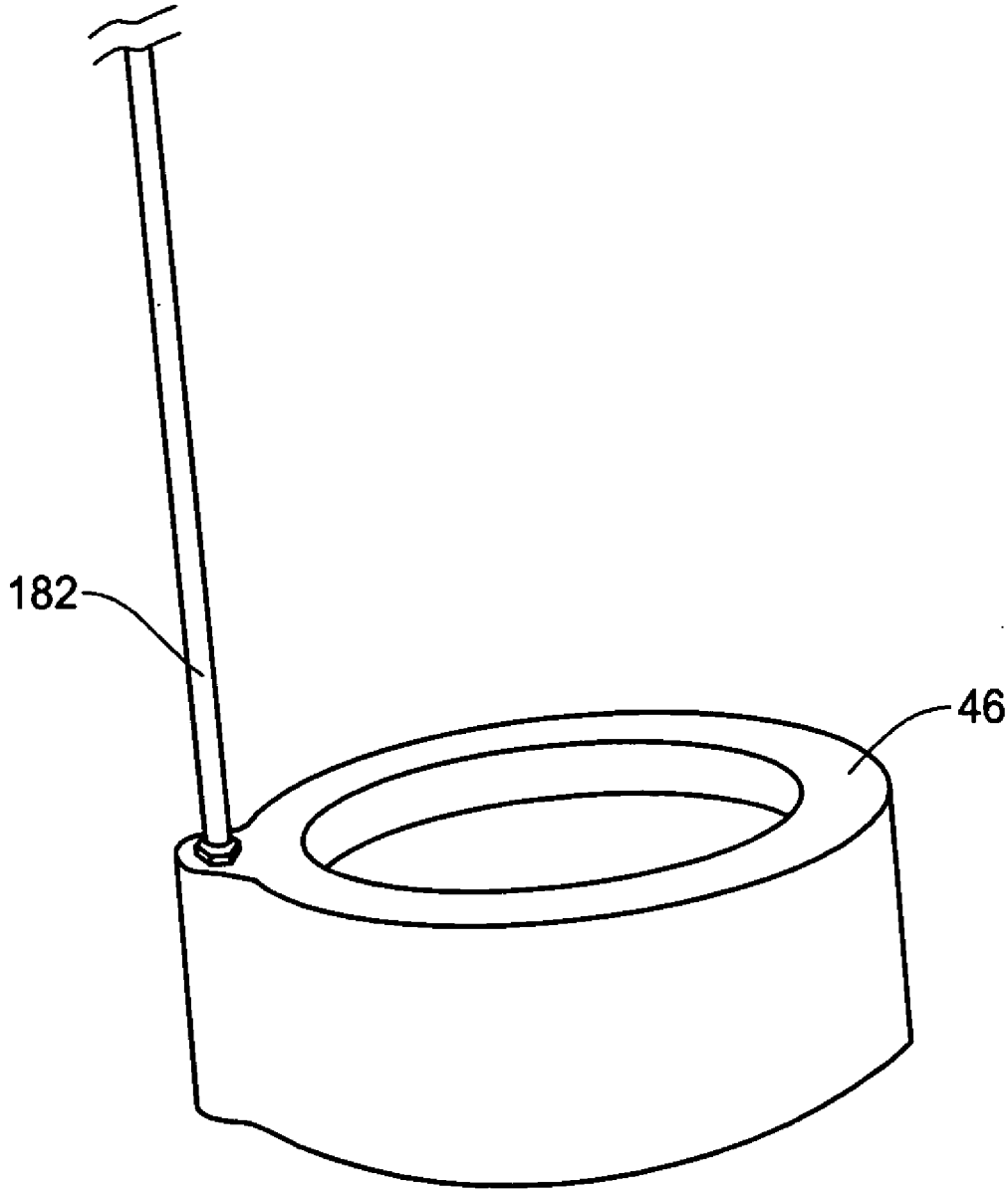
FIG. 7 is a perspective view of the drive part (shaft) and the ball stopper mechanism installed in the spherical object drop mechanism for game apparatus of the present invention.

FIG. 7 is a perspective view of the drive part (shaft) 182 and the ball stopper ring (ball stopper mechanism) 46 installed in the spherical object drop mechanism for game apparatus of the present invention. In the actual use, the ball stopper ring 46 is provided in the lower housing 42. As shown in the drawings, the ball stopper ring 46 and the drive part 182 are connected with each other. Thus, the movement of the drive part 182 is transmitted to the ball stopper ring 46. The drive part 182 is connected to the lever 180. By slightly rotating the lever 180, the motion is transmitted to the ball stopper ring 46 through 182.

Figure 8A:
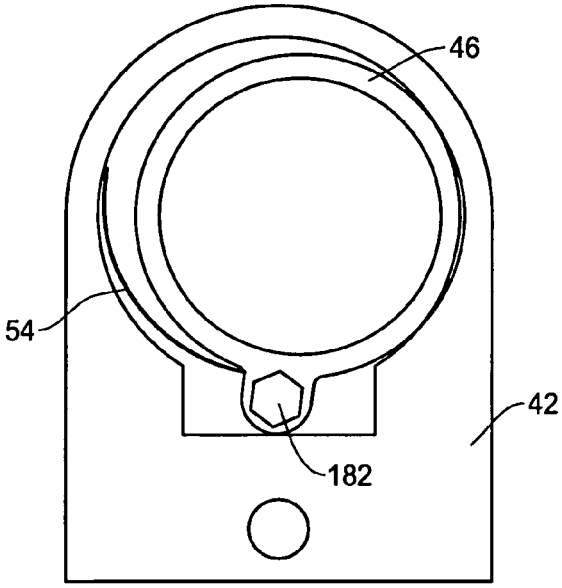
FIGS. 8A and 8B are schematic diagrams showing the operation and its positional relationship of the ball stopper mechanism stored in the lower housing in the spherical object drop mechanism for game apparatus of the present invention.
Figure 8B:
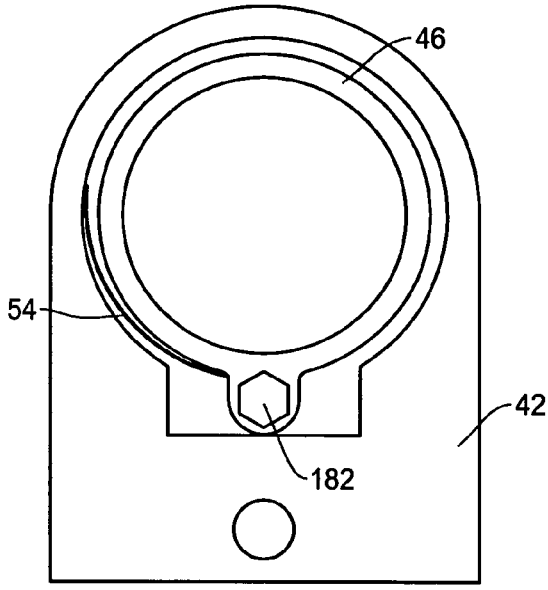

FIGS. 8A and 8B show the positional relationship between the ball stopper ring 46 and the lower housing 42 used in the spherical object drop mechanism 50 for game apparatus of the present invention. The spherical object drop mechanism 50 has a center which is rotatably connected to the drive part 182 and the ball stopper ring 46. Thus, the rotational movements generated when the user operates the lever 180 is transmitted to the ball stopper ring 46 through the drive part 182.

The internal diameter of the ball stopper ring 46 is designed to be slightly larger than the external diameter of the ball so that the ball can pass therethrough. The spring 54 is provided to the ball stopper ring 46. The spring 54 is designed so as to return the ball stopper ring 46 to the original position when the user releases the lever 180.

FIG. 8A shows the condition where the lever 180 is not operated. In this condition, the balls are stored in the spherical object (ball) drop mechanism 50 and are not dropped from the drop mechanism. This condition corresponds to that shown in FIG. 9A to be described later. On the other hand, FIG. 8B and FIG. 9B show the situation where the lever 180 is moved by the user. In this condition, the ball drops from the spherical object drop mechanism 50. This condition corresponds to that in FIG. 9C to be described later. In an actual application, there is a further situation where the lowermost ball drops within the lower housing 42 through the stopper ring 46 but will not drop from the lower housing 42 as shown in FIG. 9B. This condition will be explained later.

First, the condition is explained wherein the lever is not operated, that is, the ball is maintained in the lower housing 42. As shown in FIG. 8A, the ball stopper ring 46 is not positioned at the center but is positioned close to either one of the sides of the lower housing due to the spring force of the spring 54. Thus, the center of the ball stopper ring 46 and the center of the lower housing 42 do not match, which makes an overall size of the ball passage smaller than an outer diameter of the ball. Accordingly, the ball cannot drop because it touches the upper shoulder of the ball stopper ring 46 as shown in FIG. 9A.

When the lever 180 is moved, as shown in FIG. 8B, the force is applied to the ball stopper ring 46 against the spring 54, and the center of the ball stopper ring 46 is positioned at the center of the upper ball passage in the lower housing 42. Thus, the ball can pass through the upper ball passage. However, as shown in FIG. 9B, the center of the lower ball passage in the lower housing 42 is shifted from the center of the upper ball passage. Thus, the ball contacts the shoulder of the lower ball passage and will not drop from the lower housing.

Figure 9A:
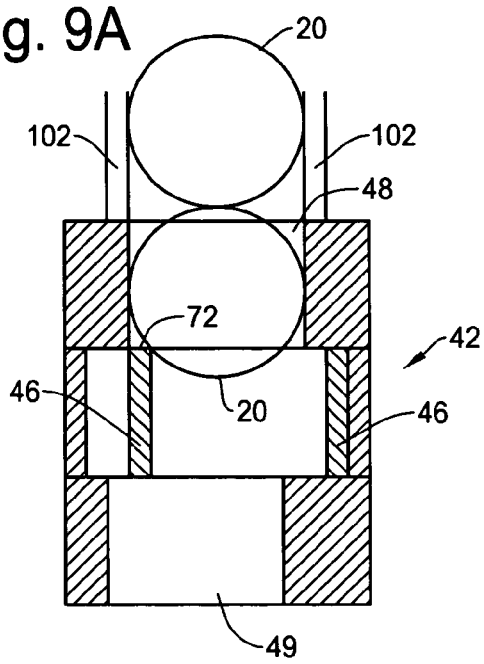
FIGS. 9A–9C are cross section views showing the ball stopper mechanism and its positional relationship in the lower housing in the spherical object drop mechanism for game apparatus of the present invention.
Figure 9B:
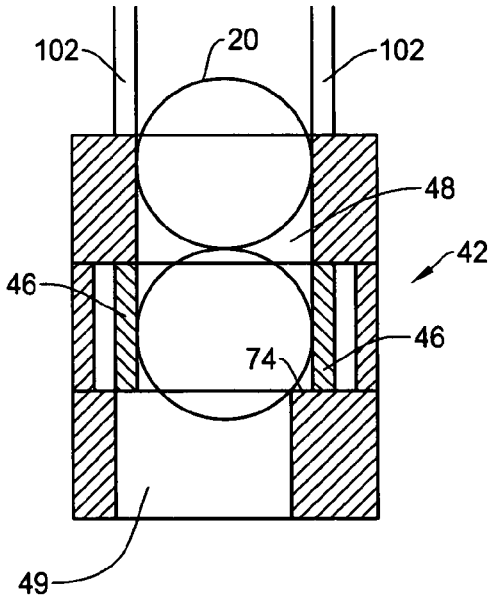
Figure 9C:
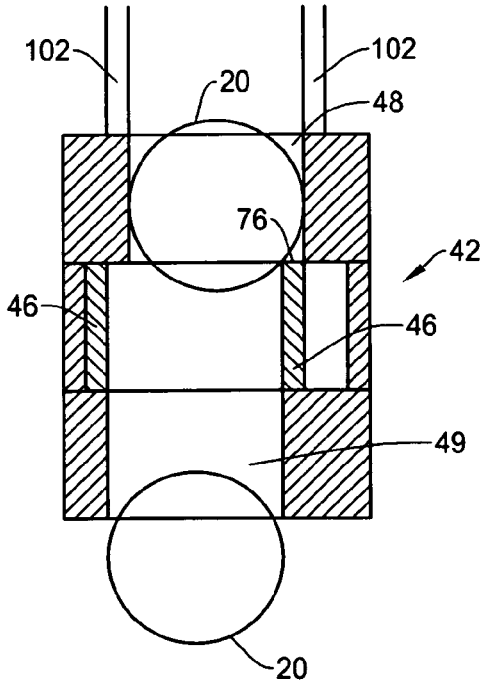

When the ball stopper ring 46 rotates further by the movement of the lever 180, and its center and the center of the lower ball passage match with one another, the ball drops on the ground as shown in FIG. 9C. When the user releases the lever 180, the lever automatically returns to the position shown in FIG. 8A.

FIGS. 9A–9C are schematic cross sectional views of the ball stopper ring 46 seen from the side of the lower housing 42. Simply stated, the spherical object drop mechanism 50 is configured to drop the lowermost ball on the ground while preventing the balls above the lowermost ball from dropping at the same time.

The ball 20 is introduced to the lower housing 42 through the ball guide 102. The ball stopper ring 46 rotates about the drive part 182. As a consequence, the ball stopper ring 46 moves in a horizontal direction in the inner space of the lower housing 42.

The upper ball passage 48 and the lower ball passage 49 are respectively formed in the lower housing 42. Both of the upper ball passage 48 and the lower ball passage 49 have the inner diameter that is slightly larger than the outer diameter of the ball 20. Thus, the ball can pass though the passages. As shown in FIGS. 9A–9C, the center of the upper ball passage 48 and the center of the lower ball passage 49 are slightly displaced from each other. Thus, the movement of the ball toward the lower position is determined by the position of the ball stopper ring 46.

FIG. 9A shows the situation where the lever 180 is not rotated. In this condition, the ball stopper ring 46 is positioned at the right side in the lower housing 42 due to the spring force of the spring 54. The center of the ball stopper ring 46 is shifted from the center of the upper ball passage 48. Thus, the ball 20 contacts the upper left portion 72 of the ball stopper ring 46, thus is prevented from moving downward.

FIG. 9B shows the situation where the user pulled the lever 180. In this condition, the ball stopper ring 46 moves toward the left in the lower housing, and its center is positioned at the center of the upper ball passage 48 in the lower housing 42. As described above, the inner diameter of the ball stopper ring 46 is just about enough to pass the ball 20 therethrough. Thus, the ball 20 drops through the ball stopper ring 46. However, since the center of the lower ball passage 49 is shifted from that of the upper ball passage 48, the ball 20 contacts the right shoulder 74 of the lower ball passage 49. Thus, the ball 20 will not drop from the lower housing 42.

FIG. 9C shows the condition wherein the user further rotates the lever 180, which further moves the ball stopper ring 46 toward the left. Thus, the center of the ball stopper ring 46 matches the center of the lower ball passage 49. Thus, the lowermost ball 20 drops to the ground due to the gravity. The upper ball 20 that is positioned above the lowermost ball 20 contacts the right upper portion 76 of the ball stopper ring 46. Thus, the upper ball 20 cannot move toward the lower position. As a result of the above noted operations, the user can drop the ball 20 on a desired spot on the ground every time when pulling the lever 180. Alternative mechanism for drop mechanism that can be used in the present invention is described in U.S. Pat. No. 6,488,593, incorporated herein by reference.

As has been described above, according to the present invention, the game apparatus is able to drop the balls one by one on the ground and to pick-up the balls on the ground one by one. Since the ball drop and pick-up mechanisms of the present invention have a simple configuration, it can achieve high reliability, ease of production, ease of use, and less needs of maintenance. Accordingly, it is able to produce the game apparatus of the present invention at low cost, light-weight, and high physical strength.

Accordingly, the game apparatus of the present invention can be enjoyed by variety of users due to the utility that allows the game apparatus to be used in either a separate ball dispenser or an integrated golf club, as well as a ball picking device that allows the user to pick-up the balls on the ground.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A game apparatus having a ball drop mechanism, comprising:

a ball guide to store a plurality of balls to be movable in a vertical direction by their own weight;

an upper support provided at an upper portion of said ball guide;

a lower housing provided at a lower portion of said ball guide;

a ball stopper mechanism provided in said lower housing to stop and release the movement of the ball in the vertical direction;

a drive part to stop and release the movement of the ball by said ball stopper mechanism; and a lever to operate said drive part from outside;

wherein said lever includes a ball picking mechanism for picking balls on the ground when the game apparatus is turned upside-down and pressed on the ball on the ground.

2. A game apparatus as defined in claim 1, further comprising a stand for supporting and holding the game apparatus vertically on the ground so that the game apparatus functions as a ball dispenser.

3. A game apparatus as defined in claim 1, further comprising:

a stand for supporting and holding the game apparatus vertically on the ground so that the game apparatus functions as a ball dispenser; and a ball exit guide formed at a bottom of the lower housing, the ball exit guide being curved or inclined to guide the ball from an upper center of the stand to outside of the stand.

4. A game apparatus as defined in claim 1, wherein, said ball picking mechanism on the lever includes an opening for introducing the balls to the ball guide, and a latch rim at an inner perimeter of the opening.

5. A game apparatus as defined in claim 4, wherein, said latch rim in said ball picking mechanism is a ring spring mounted on an inner wall of the opening, said ring spring having an inner diameter which is slightly smaller than an outer diameter of the ball, wherein said ring spring functions to extend the inner diameter when the ball is introduced in the opening and to produce resistance after the ball has passed through the ring spring by contracting the inner diameter.

6. A game apparatus as defined in claim 1, wherein, when said lever is not operated, said ball stopper mechanism is positioned to one of inner sides of said lower housing to prevent said vertical movement of said ball.

7. A game apparatus as defined in claim 1, wherein, when the upper lever is operated, said ball stopper mechanism moves in a horizontal direction within said lower housing to allow the vertical movement of said ball.

8. A game apparatus as defined in claim 1, wherein an upper ball passage and a lower ball passage are formed in said lower housing, and a center of the upper ball passage and a center of the lower ball passage are displaced from each other, and a space is provided between the upper ball passage and lower ball passage to allow horizontal movement of said ball stopper mechanism based on the operation of said lever.

9. A game apparatus as defined in claim 8, wherein, when the upper lever is not operated, the ball is prevented from moving downward by said ball stopper mechanism, and when said lever is moved and thus the ball stopper mechanism is moved in the horizontal direction in said space so that the center of said ball stopper mechanism matches the center of said upper ball passage, the ball moves downward through the ball stopper mechanism, and when said lever is further moved and thus said ball stopper mechanism is moved further in the horizontal direction in said space so that the center of the ball stopper mechanism matches the center of said lower ball passage, the ball drops to the ground through the lower ball passage.

10. A game apparatus as defined in claim 8, wherein, when said lever is operated and the center of the ball stopper mechanism matches the center of the lower ball passage to drop said ball on the ground, the ball above the dropped ball is prevented from moving downward by said ball stopper mechanism.

11. A game apparatus as defined in claim 1, wherein said drive part rotates when said lever is operated, and transmits the rotational movement to said ball stopper mechanism.

12. A game apparatus as defined in claim 1, wherein a spring is mounted on said lower housing for said ball stopper mechanism so that the spring force of said spring automatically returns said ball stopper mechanism to a default condition when a user releases said lever.

13. A game apparatus as defined in claim 1, wherein said upper support includes a ball insertion opening to supply balls to said ball guide, and a lock mechanism located near said ball insertion opening to prevent said balls from being dropped.

* * * * *